US008421706B2

(12) United States Patent
Lee et al.

(10) Patent No.: US 8,421,706 B2
(45) Date of Patent: Apr. 16, 2013

(54) METAMATERIAL MICROWAVE LENS

(75) Inventors: Jae Seung Lee, Ann Arbor, MI (US); Serdar H. Yonak, Ann Arbor, MI (US); Jungsang Kim, Chapel Hill, NC (US); Vinh N. Nguyen, Durham, NC (US); David R. Smith, Durham, NC (US)

(73) Assignees: Toyota Motor Engineering & Manufacturing North America, Inc., Erlanger, KY (US); Duke University, Durham, NC (US)

( * ) Notice: Subject to any disclaimer, the term of this patent is extended or adjusted under 35 U.S.C. 154(b) by 908 days.

(21) Appl. No.: 12/394,563

(22) Filed: Feb. 27, 2009

(65) Prior Publication Data

US 2010/0220035 A1 Sep. 2, 2010

(51) Int. Cl.
*H01Q 15/02* (2006.01)
*H01P 7/00* (2006.01)

(52) U.S. Cl.
USPC ..... 343/909; 343/753; 343/700 MS; 333/235

(58) Field of Classification Search ..... 333/202, 333/219, 235; 343/702, 700 MS, 753, 909–911 R
See application file for complete search history.

(56) References Cited

U.S. PATENT DOCUMENTS

| | | | | |
|---|---|---|---|---|
| 5,057,803 | A | 10/1991 | Ooi et al. | |
| 6,404,304 | B1 * | 6/2002 | Kwon et al. | 333/202 |
| 6,717,491 | B2 | 4/2004 | Liang et al. | |
| 6,933,812 | B2 * | 8/2005 | Sarabandi et al. | 333/219 |
| 2008/0136563 | A1 | 6/2008 | Duwel et al. | |
| 2009/0096545 | A1 * | 4/2009 | O'Hara et al. | 332/129 |
| 2009/0206944 | A1 | 8/2009 | Rofougaran et al. | |
| 2009/0262766 | A1 | 10/2009 | Chen et al. | |

FOREIGN PATENT DOCUMENTS

WO WO-2006/023195 A2 3/2006

* cited by examiner

*Primary Examiner* — Hoang V Nguyen
*Assistant Examiner* — Amal Patel
(74) *Attorney, Agent, or Firm* — Gifford, Krass, Sprinkle, Anderson & Citkowski, P.C.

(57) ABSTRACT

A metamaterial microwave lens having an array of electronic inductive capacitive cells in which each cell has an electrically conductive pattern which corresponds to incident electromagnetic radiation as a resonator. At least one cell has a first and second electrical sections insulated from each other and each which section has at least two legs. A static capacitor is electrically connected between one leg of the first section of the cell and one leg of the second section of the cell. A MEMS device is electrically disposed between the other legs of the first and second sections of the cell. The MEMS device is movable between at least two positions in response to an electrical bias between the first and second sections of the cell to vary the index of refraction and resonant frequency of the cell.

4 Claims, 3 Drawing Sheets

METAMATERIAL MICROWAVE LENS

BACKGROUND OF THE INVENTION

I. Field of the Invention

The present invention relates generally to microwave lenses and, more particularly, to a microwave lens constructed of a metamaterial with a MEMS device to vary the resonant frequency of the lens.

II. Description of Related Art

The use of metamaterials in microwave applications, such as automotive radar systems, continues to expand. Such metamaterials exhibit properties in response to incident electromagnetic radiation which vary as a function of the shape of the metamaterial rather than the composition of the metamaterial.

Conventionally, the metamaterial comprises a plurality of inductive-capacitive (LC) cells that are arranged in an array. Often, the array is planar and a plurality of arrays are stacked one upon each other to form the microwave lens. Each cell, furthermore, is relatively small relative to the wavelength of the incident radiation, typically in the range of $\frac{1}{10}\lambda$.

Each cell in the array forms an LC resonator which resonates in response to incident electromagnetic radiation at frequencies which vary as a function of the shape of the LC cell. As such, the microwave lens may be utilized to focus, defocus, steer or otherwise control a beam of microwave electromagnetic radiation directed through the lens.

One disadvantage of the previously known microwave lenses using metamaterials, however, is that the resonant frequency of the metamaterial, and thus of the lens, is fixed. In many situations, however, it would be useful to vary the resonant frequency of the lens.

One way to modify the resonant frequency of the lens is to provide a voltage controlled variable capacitor for each resonator cell which would effectively modify the resonant frequency of the cell, and thus the resonant frequency of the overall microwave lens as the value of the capacitor changes. The provision of voltage biasing lines for such variable capacitors, however, has proven problematic due in large part to the small size of each resonator cell. The provision of separate voltage biasing lines between the variable capacitors in such resonator cells also increases the number of manufacturing steps necessary to manufacture the microwave lens, and thus the overall cost of the lens.

SUMMARY OF THE PRESENT INVENTION

The present invention provides a microwave lens utilizing metamaterials which overcomes the above-mentioned disadvantages of the previously known lenses.

In brief, the microwave lens of the present invention comprises a plurality of electronic inductive capacitive cells, each of which forms a resonator having its own resonant frequency. The cells are arranged in an array, typically a planar array, and typically multiple arrays of cells are stacked one upon the other to form the lens.

At least one, and preferably each cell includes a first and second electrically isolated section and each section of the cell includes three generally parallel legs, namely a central leg and two side legs. These legs of the first and second sections are aligned with each other.

A static capacitor is electrically connected between the central leg of the first and second sections of the cell. The static capacitor enables the cell to resonate, but blocks DC current through the static capacitor.

A MEMS device is then electrically connected between each side leg of the first and second sections of the cell. These two MEMS devices are movable between at least two positions in response to an electrical bias between the first and second sections of the cell to thereby vary the index of refraction and resonant frequency of the cell and thus of the microwave lens.

A first conductive strip electrically connects the first sections of the cell in the array together while, similarly, a second conductive strip electrically connects the second sections of the cells in the array together. Upon application of a voltage bias between the first and second conductive strips, the MEMS device moves to thereby change the resonant frequency of the lens by varying the index of refraction of the cells in the array.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
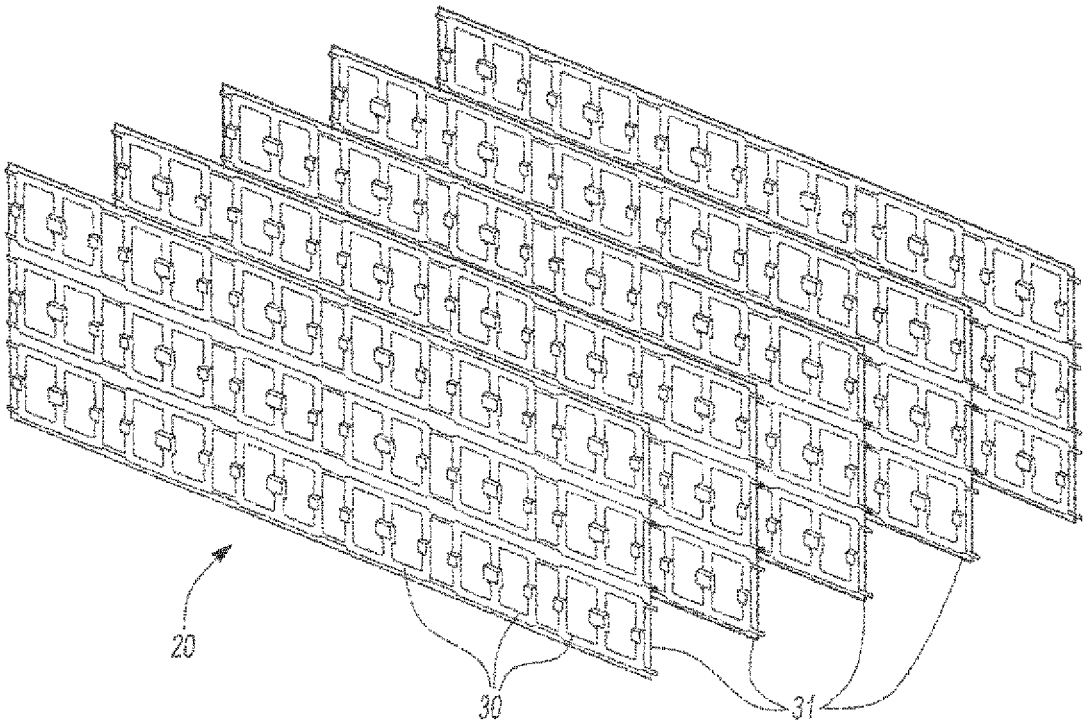
FIG. 1 is an exploded elevational view illustrating a preferred embodiment of the present invention.

With reference first to FIG. 1, a microwave lens 20 is shown which comprises a plurality of electronic inductive capacitive (ELC) resonant cells 30. These cells are arranged in a planar array 31. Each array, furthermore, is illustrated in FIG. 1 as being rectangular in shape, although other shapes may be utilized without deviation from the spirit or the scope of the invention.

Although a single planar array may form the microwave lens, more typically a plurality of planar arrays 31 are stacked one on top of each other to form the lens.

Figure 2:
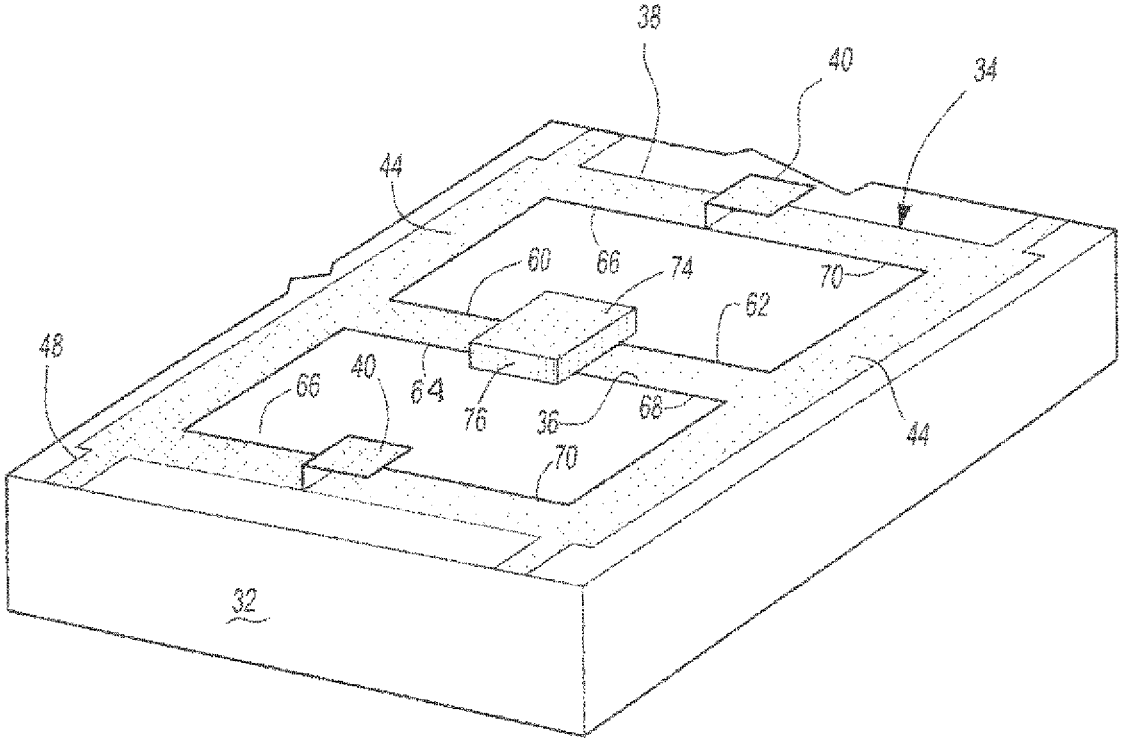
FIG. 2 is an elevational view of a single resonator cell.

With reference now to FIG. 2, a single resonator cell 30 is there shown in greater detail. The resonator cell includes a substrate 32 made of an electrical insulating material. A conductive pattern 34 is formed on the substrate using conventional manufacturing techniques. This pattern 34, furthermore, forms the general shape of the ELC cell 30.

Still referring to FIG. 2, the pattern 34 includes a central leg 36 and two side legs 38 that are spaced apart and generally parallel to each other. Furthermore, the size of the cell 30 is relatively small compared to the incident radiation, typically in the neighborhood of $\frac{1}{10}\lambda$, so that the array 31 of cells 30 forms a metamaterial. As such, the shape of the cells 30 varies the index of refraction of the planar array 32 and thus the resonant frequency of the microwave lens 20.

Still referring to FIG. 2, each cell 30 includes a first section 60 and a second section 62. The first cell section 60 includes a central leg segment 64 and two side leg segments 66. Similarly, the second section 62 of the cell 30 includes a central leg segment 68 and two side leg segments 70.

The first and second sections 60 and 62 of the cell 30 are aligned with each other so that the central leg segments 64 and 68 are in line with each other and form the central leg 62 of the cell. Similarly, the side leg segments 66 of the first cell section 60 are aligned with the side leg segments 70 of the second cell section 62 to form the two side legs 38 of the cell 30.

Figure 3:
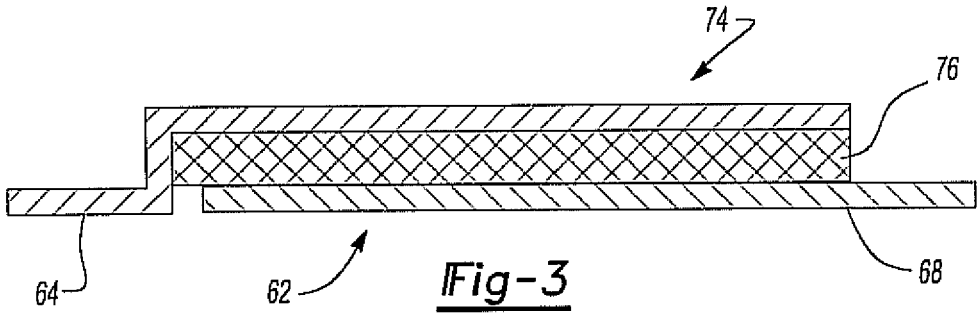
FIG. 3 is a side diagrammatic view illustrating the static capacitor.

With reference now to FIGS. 2 and 3, a static capacitor 74 is electrically connected between the central leg segments 64 and 68 of the first and second cell sections 60 and 62. As best shown in FIG. 3, a portion of the leg segment 64 of the first cell section 60 overlies a portion of the central leg segment 68 of the second cell section 62 while a layer 76 of electrically nonconductive material, such as silicon oxide, is disposed between the leg segments 64 and 68. As such, the nonconductive layer 76 electrically insulates the two central leg segments 64 and 68 from each other and prevents the passage of DC current through the central leg 36 of the resonator cell 30.

Figure 4:
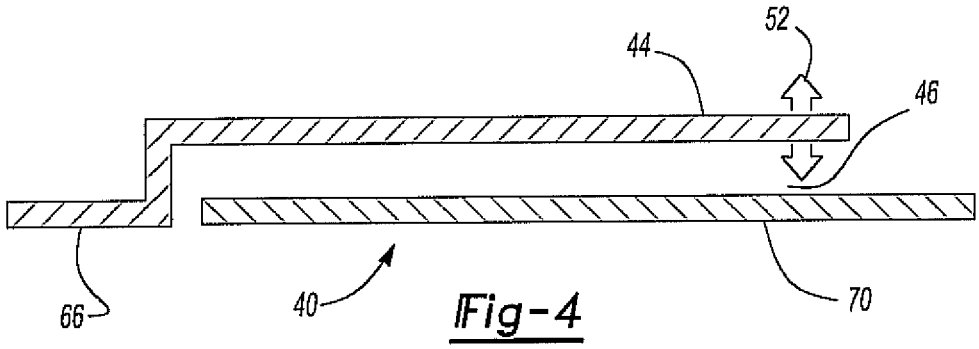
FIG. 4 is a view similar to FIG. 3, but illustrating the MEMS device.

With reference now to FIGS. 2 and 4, in order to vary the refractive index of the resonator cell 30, and thus the resonant frequency of the cell 30, at least one microelectromechanical (MEMS) device 40 is associated with at least one, and more typically, all of the resonator cells 30 in the array 31. For example, as shown in FIG. 2, one MEMS device 40 is associated with each of the side legs 38 of the resonator cell 30.

With reference now to FIG. 4, one MEMS device 40 is there shown greatly enlarged. The MEMS device 40 is electrically connected or disposed between the side leg segment 66 of the first cell section 60 and the side leg segment 70 of the second cell section 62. The MEMS device 40 includes a cantilevered portion 44 of the side leg segment 66 which extends over, but is spaced upwardly from, a portion of the side leg segment 70 of the second cell section 62. As such, the MEMS device 40 forms a capacitor which is connected in series between each side leg 38 of the resonator cell 30. Furthermore, an air gap 46 between the cantilevered portion 44 of the first side leg segment 66 and the second side leg segment 70 of each MEMS device 40, together with the static capacitor 74 (FIG. 3), electrically insulate the first section 60 of the resonator cell from the second section 62.

With reference again to FIG. 2, a first conductive strip 48 extending between adjacent cells 30 electrically connects all of the first sections 60 of the cells 30 in the planar array 31 together. Similarly, a conductive strip 50 also extending between adjacent cells 30 electrically connects all of the second sections 62 of the cells 30 in the planar array 31 together.

With reference again to FIGS. 2 and 4, a voltage bias may be applied between the first and second sections 60 and 62 of the cells 60 through their respective conductive strips 48 and 50. Upon doing so, the cantilevered portion 44 of the MEMS device 40 will flex, as indicated by arrows 52, between at least two different positions in response to that voltage bias. In doing so, the capacitive value exhibited by the MEMS device 40 will also vary thus varying the index of refraction of the lens 20 and thus the resonant frequency of the lens 20.

Figure 5:
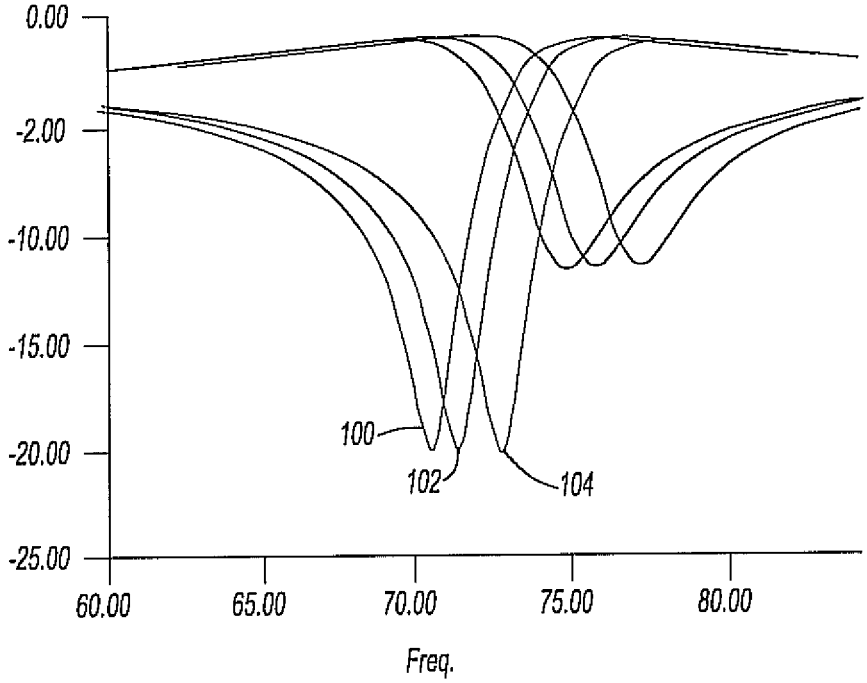
FIG. 5 is a graph illustrating the change in resonant frequency of the lens as a function of the width of the static capacitor.

With reference now to FIG. 5, the characteristics of the microwave lens 20 may be varied by varying the width of the static capacitor 74. For example, a plot of the S-parameter characteristics as a function of frequency for a static capacitor having a width of 120 micrometers is shown at graph 100. This resonant frequency may be increased by narrowing the width of the static capacitor 74 to 100 micrometers, as shown in graph 102, or to 80 micrometers, as shown in graph 104.

Figure 6:
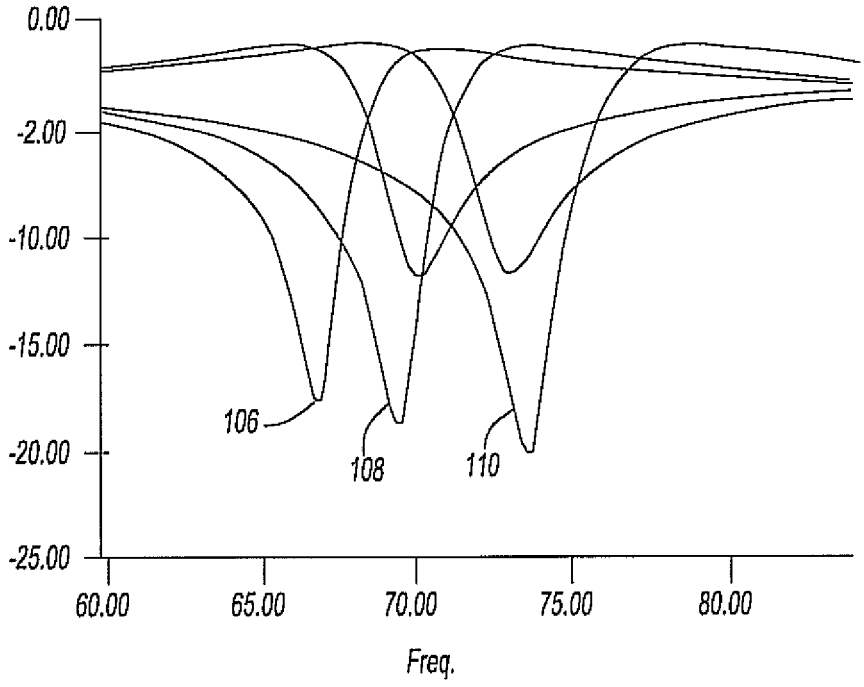
FIG. 6 is a graph illustrating the variations in resonant frequency as a function of the position of the MEMS device.

With reference now to FIG. 6, FIG. 6 illustrates the S-parameter transmission as a function of frequency achieved by varying the spacing of the MEMS device 40 between a low of 5 micrometers, as shown at graph 106; a spacing of 7 micrometers, as shown at graph 108; and a spacing of 9 micrometers, as shown at graph 110. Consequently, the greater the spacing between the portion 44 (FIG. 4) of the MEMS device 40 and the leg segment 70 increases the resonant frequency of the resonator cell 30.

From the foregoing, it can be seen that the present invention provides a microwave lens constructed from a metamaterial which is tunable to vary the index of refraction, and thus the resonant frequency, of the microwave lens as desired. Furthermore, since each cell in the array of resonator cells is formed by two electrically insulated resonator cell sections, the application of the electrical voltage necessary to actuate the MEMS device to vary the response of the lens may be simply accomplished by the electrical conductive strips which may be formed simultaneously with the formation of the conductive cells and without the need for additional electrical insulators.

Having described our invention, however, many modifications thereto will become apparent to those skilled in the art to which it pertains without deviation from the spirit of the invention as defined by the scope of the appended claims.

We claim:

1. A metamaterials microwave lens comprising:

an array of electronic inductive capacitive cells, each cell having an electrically conductive pattern which responds to incident microwave electromagnetic energy as a resonator, at least one cell having a first and a second electrical sections electrically insulated from each other, each section having a central leg and two spaced apart and parallel linear side legs, a static capacitor electrically connected in series with said central leg of said at least one cell first section and one leg of said at least cell second section, a pair of MEMS devices, one MEMS device electrically in series with each of said side legs of said first and second sections of said at least one cell, each MEMS device having a cantilever portion of said first section which overlies a portion of said second section of said at least one cell and movable between at least two positions in response to an electrical bias between said first and second sections of said at least one cell to thereby vary the capacitance of each said MEMS device and thereby vary the resonant frequency of said at least one cell, and a first conductive strip which electrically connects said first sections of said cells together, and a second conductive strip which electrically connects said second sections of said cells together.

2. The invention as defined in claim 1 wherein said static capacitor comprises a portion of said one leg of said at least one cell first section overlies and is spaced from a portion of said one leg of said at least one cell second section, and an electrical insulating material disposed between said leg portions.

3. The invention as defined in claim 1 wherein said at least one cell comprises a plurality of cells in said array.

4. The invention as defined in claim 1 wherein said at least one cell comprises all of said cells in said array.

* * * * *